US005716333A

United States Patent [19]

Larsen

[11] Patent Number: 5,716,333

[45] Date of Patent: Feb. 10, 1998

[54] NECK JET PILLOW

[75] Inventor: Christopher Larsen, Vista, Calif.

[73] Assignee: Watkins Manufacturing Corporation, Vista, Calif.

[21] Appl. No.: 659,072

[22] Filed: Jun. 4, 1996

Related U.S. Application Data

[63] Continuation of Ser. No. 321,747, Oct. 12, 1994, abandoned.

[51] Int. Cl.[6] ..... A61H 33/02

[52] U.S. Cl. ..... 601/148; 601/149; 601/157; 4/578.1

[58] Field of Search ..... 601/148–150, 601/154–160; 4/575.1, 546

[56] References Cited

U.S. PATENT DOCUMENTS

| | | | |
|---|---|---|---|
| 1,076,490 | 10/1913 | Dreuw . | |
| 1,780,876 | 11/1930 | Grosse . | |
| 3,396,722 | 8/1968 | Lindberg, Jr. . | |
| 3,483,862 | 12/1969 | Takeuchi | 128/33 |
| 3,720,204 | 3/1973 | Wojtowicz | 128/64 |
| 3,736,924 | 6/1973 | Jacuzzi et al. . | |
| 3,842,823 | 10/1974 | Jacuzzi et al. . | |
| 3,874,374 | 4/1975 | Jacuzzi . | |
| 4,139,001 | 2/1979 | Macabee . | |
| 4,220,145 | 9/1980 | Stamp et al. | 128/66 |
| 4,313,432 | 2/1982 | Sievers | 128/37 |
| 4,339,833 | 7/1982 | Mandell | 4/542 |
| 4,561,133 | 12/1985 | Laing | 4/491 |
| 4,575,882 | 3/1986 | Diamond | 4/559 |
| 4,635,619 | 1/1987 | Diamond | 128/39 |
| 4,757,808 | 7/1988 | Effler Jr. | 128/66 |
| 4,825,854 | 5/1989 | Henkin et al. | 601/157 |
| 4,839,930 | 6/1989 | Watkins | 4/546 |
| 4,860,392 | 8/1989 | Gardenier et al. | 601/157 X |
| 4,908,888 | 3/1990 | Watkins | 4/542 |
| 4,926,510 | 5/1990 | Watkins | 4/542 |
| 4,953,240 | 9/1990 | Gardenier | 601/157 X |
| 5,230,106 | 7/1993 | Henkin et al. . | |
| 5,333,324 | 8/1994 | Pinciaro | 4/567 |

FOREIGN PATENT DOCUMENTS

| | | | |
|---|---|---|---|
| 213041 | 5/1908 | Germany . | |
| 2601506 | 1/1978 | Germany . | |
| 3943435 | 7/1991 | Germany | 601/148 |
| 50-146381 | 5/1949 | Japan . | |
| 57-164061 | 10/1982 | Japan . | |
| 57-57697 | 12/1982 | Japan . | |

OTHER PUBLICATIONS

Purported Patent App. of Henkin et al. & cover letter dated Apr. 16, 1993 (See discussion of 3rd Embodiement pp. 35–37.

Cal Spas Brochure.

Coleman Spas Brochure.

Aqua Magazine, Oct. 1993 issue, p. 21.

*Primary Examiner*—Danton D. DeMille

*Attorney, Agent, or Firm*—Price, Gess & Ubell

[57] ABSTRACT

A unitarily-molded pillow for mounting in a spa and having a flexible membrane positioned therein and with respect to a water discharge jet by an integrally-molded support structure including an upper collar, a lower rim, and respective side shoulders, the support structure being integrated into a smooth, contoured front surface providing integral neck and head support, with the membrane positioned to provide a pleasing warm neck massage effect and the jet being adjustable via an air valve for user comfort.

9 Claims, 4 Drawing Sheets

NECK JET PILLOW

This application is a continuation of U.S. patent application Ser. No. 08/321,747, filed Oct. 12, 1994, now abandoned.

BACKGROUND OF THE INVENTION

1. Field of the Invention

The subject invention relates to spas, whirlpools, and the like and, more particularly, to apparatus providing a neck massage system in association with such equipment.

2. Description of Related Art

Spas, whirlpools, and the like are generally known in the prior art and have become increasingly popular as a source of relaxation and therapy. They generally include a spa shell or "tub" fabricated of various materials such as fiberglass-reinforced polyester, acrylic, ABS, and vinyl. "Tub" as used herein may be a spa tub, whirlpool tub, bathtub, a pool, or similar apparatus for containing water.

In connection with such spas, it has appeared particularly desirable to provide a neck massage system. Prior art approaches to providing neck massaging action have typically provided one or more jets at or above the spa water level which direct water under pressure directly toward the user's body. A small cushion or collar has been provided adjacent the expanded jet(s) to prevent direct contact between the head and the hard spa surface material and to otherwise cushion the head or neck area.

One problem with such prior art approaches to neck massage systems is that considerable splashing of water occurs around the neck and head area. Aside from being annoying, water can splash into the ear or onto the hair, creating discomfort and potential health problems. One approach to remedying this problem is to provide a surface on the spa shell which overhangs the jets and thereby reduces splashing. Provision of such surfaces in molded spa shells creates fabrication problems and does not entirely eliminate splashing.

Another problem with the prior art is that the design approach results in jets which are positioned too low. In other words, the neck of the user tends to be just out of the water such that jets which would effectively reach the neck create a considerable amount of splashing, whereas jets placed lower, at or near the water level, are muzzled by the spa water pool and do not reach the upper part of the neck.

An effort to meet some of the foregoing problems is represented by U.S. Pat. No. 4,839,930 assigned to the present assignee. That patent discloses a discharge head comprising a frustoconical bezel. The circular opening of the bezel is fitted with a flat, flexible diaphragm. The diaphragm must be inflated by complicated internal structure. Complex piping and venting mechanisms are also required.

While the mechanism of the '930 patent addresses some of the problems of the prior art, its high part count and complicated structure make it impractical for manufacture and use. In addition, the projecting flat diaphragm structure is ungainly in appearance and provides far less than ideal head and neck support.

OBJECTS AND SUMMARY OF THE INVENTION

It is therefore an object of the invention to improve spas, whirlpools, and the like;

It is another object of the invention to provide an improved neck massage system for use in conjunction with spas, whirlpools, and the like;

It is yet another object of the invention to provide such a neck massage system which eliminates undesirable splashing;

It is still another object of the invention to provide a system which provides massaging of the entire neck;

It is another object of the invention to provide such a system which more optimally positions the massage apparatus;

It is another object of the invention to provide a substantially dry neck massage system in connection with a spa, whirlpool, or the like;

It is another object of the invention to provide a neck massage component for a spa which is suitable for fabrication as a single-piece moldable unit;

It is another object of the invention to achieve a waterfall effect wherein the water ejected from the massaging jets is permitted and directed to flow down and about the lower neck, shoulders, and back of the user, providing a continuous soothing flow of warm water to areas of the body not affected by the dry neck massage; and It is yet another object of the invention to provide a neck massage system which greatly reduces part count and complexity, while providing integral support and massage functions.

According to the invention, a neck jet pillow is provided featuring a thin membrane area and a surrounding structure for supporting the membrane and for positioning it with respect to the head, neck, and spa. The membrane is made thin and flexible with respect to the supporting structure so as to achieve a pillow-like effect. One or more fixed or rotating jets are positioned in the spa and directed onto the membrane area, providing a pulsating neck massage action without direct contact between the water streams and the user. Other aspects of the preferred pillow include an upper collar portion having a rim which conforms to the spa perimeter, and thereby precludes splashing, as well as means for directing the water jet(s) such that the jet stream impacts against the membrane and then cascades down, creating a pleasing waterfall effect.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a readily manufactured, particularly effective, and aesthetically pleasing neck massaging apparatus.

Figure 1:
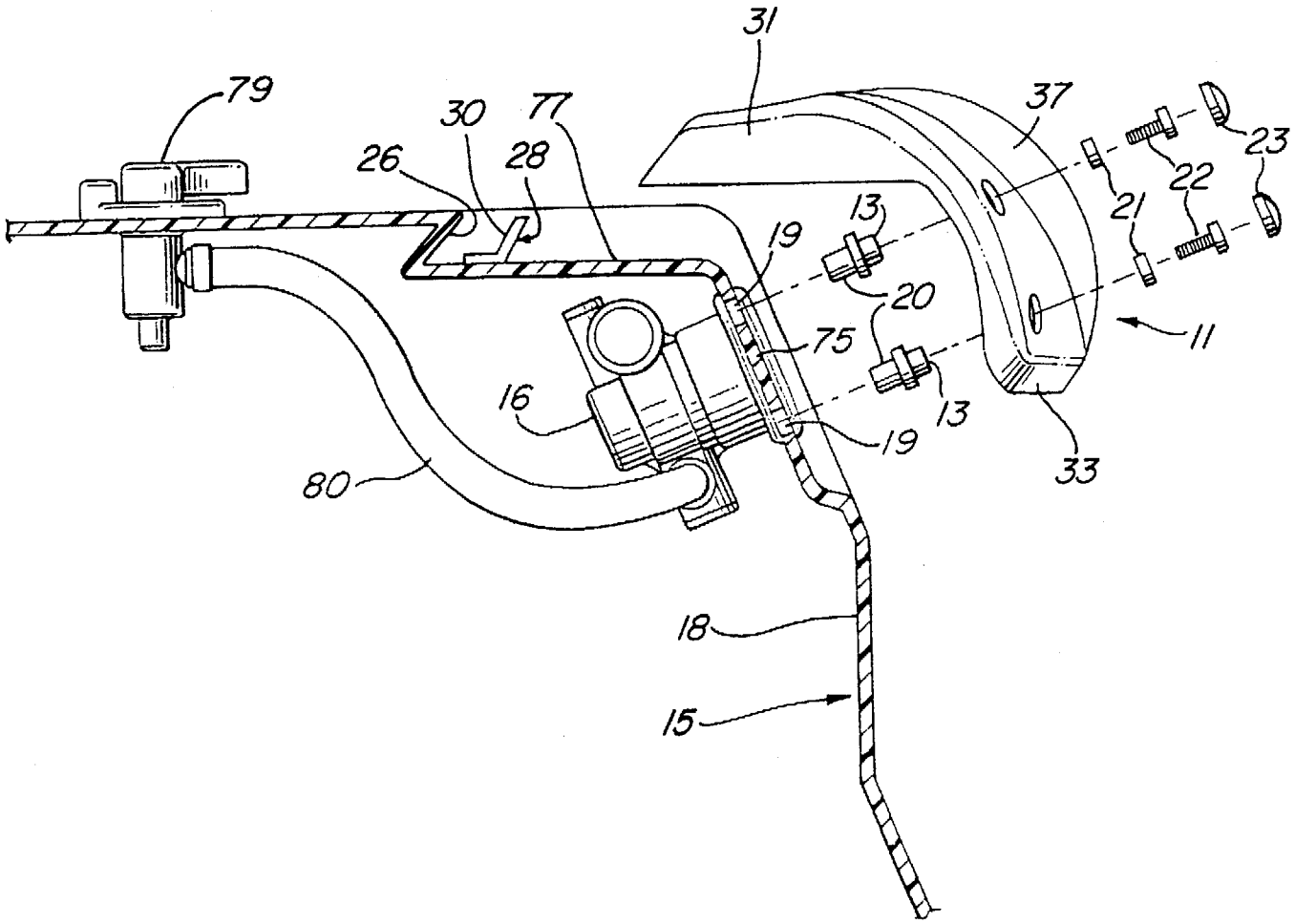
FIG. 1 is a side view illustrating a preferred embodiment of the invention.
Figure 2:
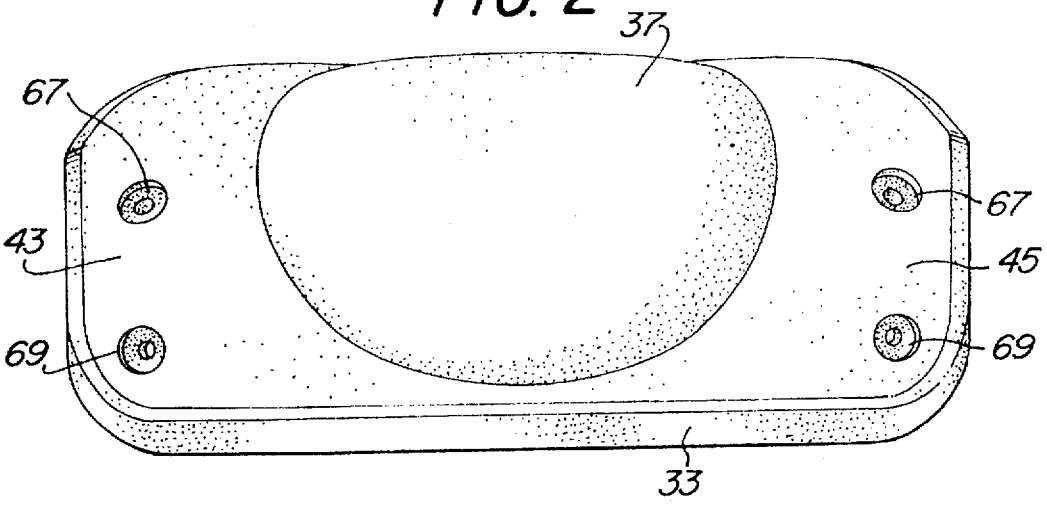
FIG. 2 is a front view of a neck jet pillow according to the preferred embodiment.
Figure 3:
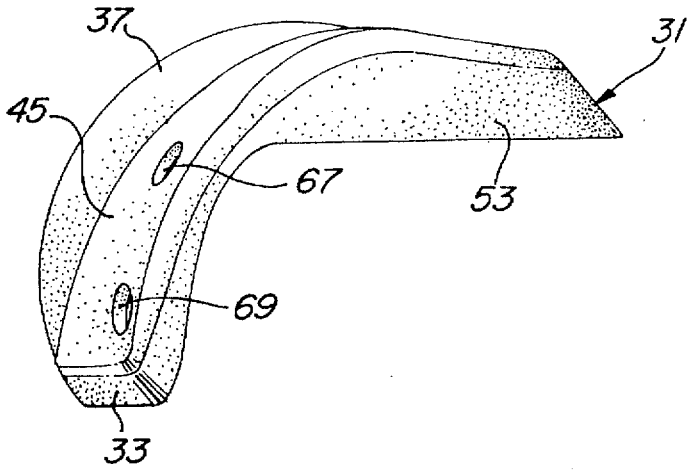
FIG. 3 is a side view of the pillow of FIG. 2.

FIG. 1 shows a cross-sectional view of a spa shell 15 and a cooperating neck jet pillow 11 according to the preferred embodiment. The pillow 11 generally includes an upper collar 31, a lower rim 33, and a thin membrane 37. The membrane 37 is positioned by the structural relationship between the spa shell 15 and the pillow 11 to receive one or more pulsating jets of water from one or more jets 16.

Various fastening mechanisms can be used to attach the pillow 11 to the spa shell 15. According to the approach shown in FIG. 1, bosses 20 having a cavity bore to accept self-tapping screws 22 are glued or otherwise fixed in respective apertures 19 in the spa shell 15 for receiving respective mounting screws 22 and washers 21, which attach the pillow 11 to the spa shell 15. The front heads 13 of the bosses 20 are inserted into the openings 19 from the back side 18 of the spa shell 15. Respective screw covers 23 are preferably provided for aesthetic appearance.

The jet(s) 16 are conventional pump-driven water jets, conventionally mounted in the spa shell 15. Various types of jets may be used. For example, the discharge jet 16 may be in the nature of a venturi jet nozzle adapted to optimize the entrainment of the air into the water prior to discharge. The discharge jet 16 may have a reciprocating or circular motion within the head assembly to increase the benefits of the massage. A pulsating jet may also be utilized.

Figure 4:
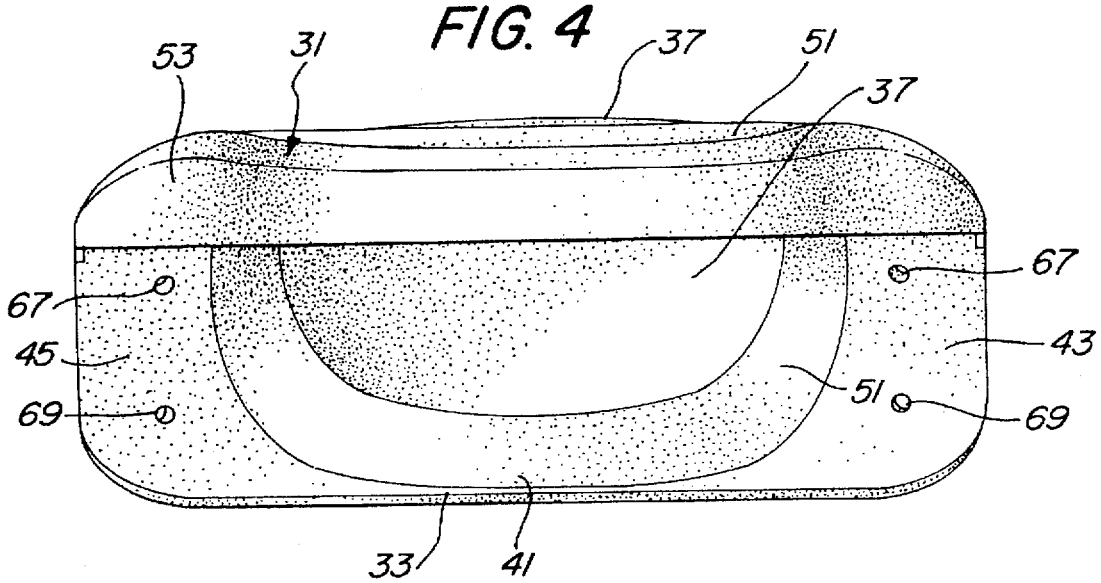
FIG. 4 is a back elevational view of the preferred neck jet pillow.

The detailed structure of the neck jet pillow 11 is further illustrated in FIGS. 2–7. With particular reference to FIG. 4, it may be seen that the membrane 37 of pillow 11 has an oval perimeter and is bubble-like in its manner of projection from the surrounding supporting structure. This supporting structure includes a support frame 51, which rings the membrane 37 and forms into the remainder of the surrounding body of the pillow 11, the body including respective side shoulders or flanges 43, 45 and an upper collar 31. The ring-like support frame 51 includes a floor portion 41 which descends away from the membrane 37 and integrally forms into a lower rim 33.

Each side flange 43, 45 has first and second screw holes 67, 69 for receiving fastening devices for mounting the pillow 11 to a cooperating spa structure. While various mounting means will be apparent to those skilled in the art, the holes 67, 69 preferably are designed to receive the respective washers 21, screws 22, and screw covers 23. The holes 67, 69 may be appropriately countersunk as desired to provide for appropriate concealment of the mounting devices.

Figure 5:
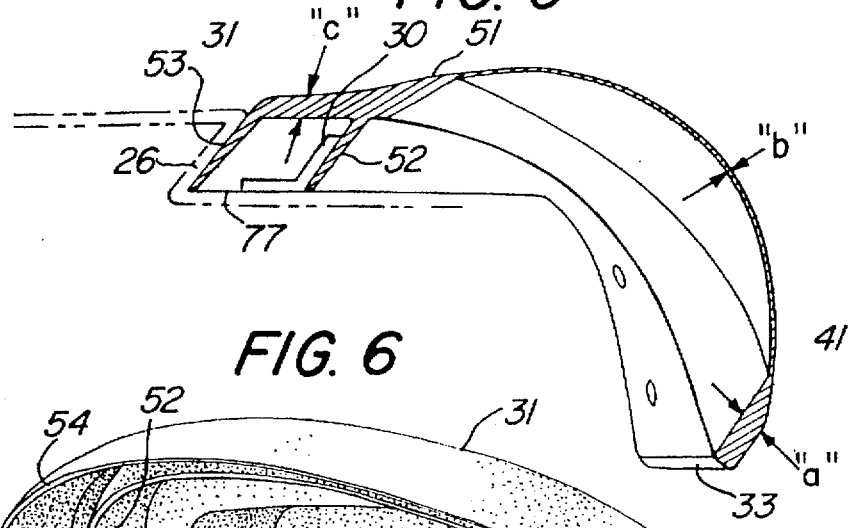
FIG. 5 is a sectional view taken at 5—5 of FIG. 4.
Figure 6:
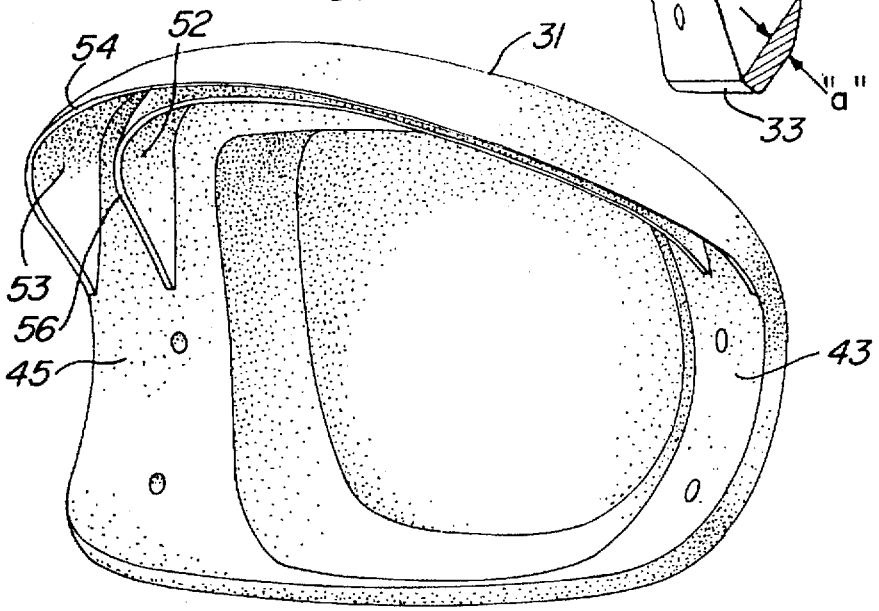
FIG. 6 is a perspective view from a point sidewardly and rearwardly of a neck jet pillow according to the preferred embodiment.
Figure 7:
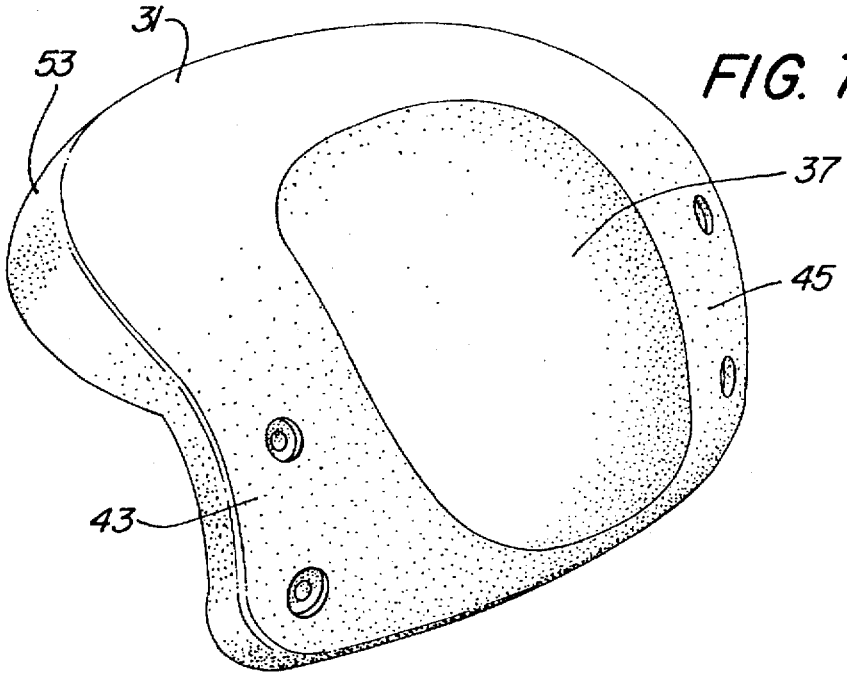
FIG. 7 is a front perspective view of the pillow according to the preferred embodiment.

As shown in the cross-section of FIG. 5, the floor 41 of the support frame 51 descends away from the membrane 37 and transitions in thickness to a much thicker and sturdier dimension. The membrane 37 is thin, for example, $^{20}/_{1000}$-inch (20 mils) in thickness "b" throughout its generally oval contour, and transitions relatively abruptly in thickness to the much sturdier thickness of supporting ring 51. The ring 51 integrally forms into the collar 31, which includes a swept-back, generally curvilinear edge 53. Within the perimeter of the edge 53 is an integrally-molded splash guard 52. The edge 53 is preferably contoured such that its entire perimeter rim 54 abuts the spa shell 11, as does the rim 56 of the splash guard 52. Illustrative dimensions for the preferred structure shown in FIG. 5 are a=$^{5}/_{16}$-inch, b=20 mils, and c≅$^{5}/_{16}$-inch. Such dimensioning, of course, may be varied without departing from the invention.

Overall, the membrane portion 37 is preferably sized and contoured to receive and position substantially the entire neck of the user against the membrane portion 37, while lending support to the head, so that the user may enjoy a completely relaxed neck massage without annoying splashing.

The portion of the lower rim 33 between the two side flanges 43, 45 may be contoured to track the side surface of the spa 15 and so as to be gapped away therefrom by a selected distance. Such a gap between the lower rim 33 and the side of the spa 15 may be a constant distance, for example, on the order of one inch.

Figure 8:
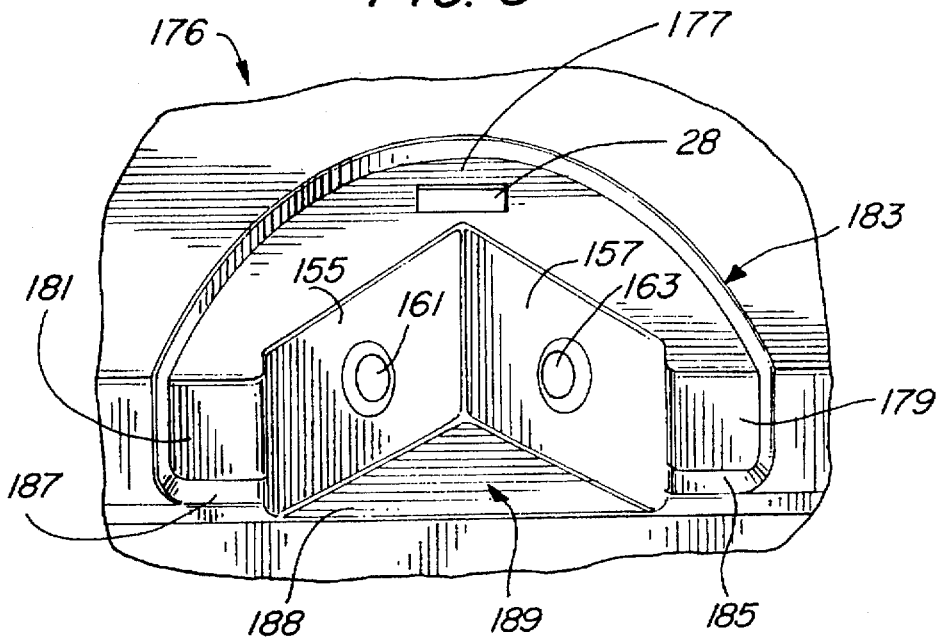
FIGS. 8 and 9 are perspective views of spa structure for cooperating with the neck jet pillow of the preferred embodiment.

The collar 31 and the side flanges 43, 45 of the preferred embodiment are further preferably designed to provide integral mounting with cooperating surfaces of the spa 15. In particular, the rim 54 of the collar 31 may mount flush against a cooperating planar upper floor surface 77 of the spa shell 15, for example, as shown in FIGS. 1 or 8. As shown in FIGS. 1 and 5, the spa shell preferably has a reverse draft or inclined surface 26 angled to matingly receive the angled curvilinear edge 53 of the pillow 11. A plastic brace 28 is further preferably glued to the floor surface 77 and has an obtusely angled brace surface 30 having a rectangular face which abuts and mates with an appropriately-shaped middle portion of the splash guard 52. Both the mating reverse draft surface 26 and the brace 28 serve to hold the collar 31 and the rim 54 down against spa surface 77. In this manner, the collar 31 and rim 54 are prevented from rising under water pressure generated by the jets 16 such that water may not escape upwardly, but is instead forced downwardly.

The integrally-formed rear surfaces of the side flanges 43, 45 also preferably fit flush against the mounting surface area 75 of the spa 15. The flanges 43, 45, together with the curvilinear edge 53, cooperating surface 26, brace 28, and splash guard 52, then complete a 270-degree gasket-like seal about the user's head and neck area. This seal prevents water produced by the pulsating jets 16 from exiting other than through the gap between the lower rim 33 and the side of the spa 15, keeping the user dry above and about the pillow 11. The contours of the collar 31 and lower rim 33 can, of course, be varied to accommodate various spa shapes.

Figure 9:
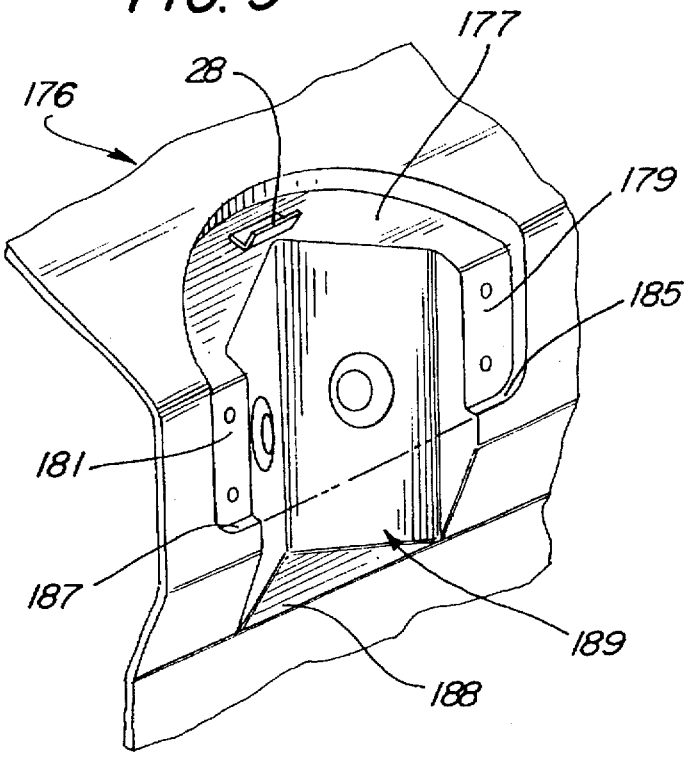

FIGS. 8 and 9 illustrate another embodiment of spa shell structure 176 which may cooperate with the neck jet pillow 11 of the preferred embodiment. This structure includes an upper floor 177 and a lower floor 188. The lower floor 188 is triangular in shape and has two edges defined by first and second side walls 155, 157 which meet one another at an angle and dispose two jet openings 161, 163. This structure 176 includes an outer edge 183 which defines an edge structure including a vertical edge 165 forming into two respective side edges 179, 181 which then form into two bottom edges 187, 185. This edge structure is molded to snugly and continuously receive the corresponding edges of the pillow 11 so as to form a seal around the entire perimeter thereof except for the perimeter portion of the lower rim 33 which lies between the bottom edges 187, 185. In this region an opening 189 is created where water may flow downward behind the pillow 11 and out into the surrounding spa water.

The spa shell structure 176 may be, and preferably is, molded during initial molding of a unitary spa shell. It provides for the angled array of one, two, or more jets located in suitable jet openings 161, 163 so as to direct their water streams at the membrane 37 of the pillow 11.

In operation of the massage system of the preferred embodiment, pulsating water from the jet(s) 16 beats against the membrane 37 which, in turn, transmits a pleasing massage effect to the neck of the user. Water travels away from the membrane 37 with the assistance of the descending floor 41 and exits into the spa water beneath the lower rim 33, providing a pleasing waterfall effect. The overall structure presents a continuous, aesthetically pleasing front surface for supporting the neck in pillow-like fashion.

The pillow structure of the preferred embodiment is particularly adapted to injection molding or exothermic foam molding processes. While various materials known in the art may be used to mold a pillow structure according to the invention, the preferred pillow is preferably fabricated from a polyester-based or polyether-based thermoplastic urethane material, for example, such as Elastollan 1100 Series No. 1180A, as available from BASF, Wyandotte, Mich. Such materials exhibit excellent low-temperature properties, hydrolysis resistance, and fungus resistance, and are suitable for injection molding, blow molding, and extrusion.

The preferred approach to producing the subject invention is one known to those skilled in the art, i.e., the preferred pillow is designed using computer-aided design, which permits both structural design and mold generation via computer. In particular, design may be done in I-DEAS 3-D modeling software version 1.3c using the "master modeler" and "master surfacing" modules, as available from Structural Dynamics Research Corp., Milford, Ohio. The I-DEAS-generated model may then be output into an I.G.E.S. file for transfer, for example, into Esprit's CAM software, as available from Esprit Corp., for final detailing and mold generation.

The pillow structure constructed according to the preferred embodiment has the additional advantage that it readily absorbs heat from the spa water and conducts it throughout the pillow 11. Thus, the pillow 11 and membrane 37 are heated and maintain a consistent temperature throughout operation, thereby providing a soft, heated, pulsating massage action and effect.

To provide additional utility, an air valve 79 may be installed in the spa exterior surface for convenient access by the user. The air valve 79 may be a conventional valve connected with the jet 16 through tubing 80 and is adjustable to vary the flow out of the jet 16 for fine tuning user comfort.

While it is highly advantageous to integrally mold the pillow 11 as a unitary molded article to provide for easy manufacture, accurate massage transmission and a pleasant, warm feel, structures according to the invention could be fabricated of several individually molded or otherwise separately fabricated parts attached together by various conventional means. Thus, for example, a frame structure may be fabricated in one step, for example, by molding or other processes, and a membrane formed in a separate step and attached to the frame by welding or other processes.

The structure of the preferred embodiment for supporting the membrane is sturdy, and generally exhibits relatively smooth transitioning surfaces free of abrupt ribs, shoulders, and the like. Various alternative embodiments with various ribs, shoulders, and similar support structures for the membrane could be provided without departing from the scope of the invention.

Those skilled in the art will thus appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Apparatus comprising:

a tub having a side surface therein and a jet means mounted in said side surface for discharging fluid under pressure; and a unitarily-molded single-piece solid plastic pillow means having an oval flexible membrane formed therein, said solid plastic pillow means further including a plastic support means integrally and unitarily forming into said oval membrane, said support means exhibiting less flexibility than said membrane for supporting said oval membrane so as to permit vibration of said membrane with respect to said support means, and first and second flange means located on opposite sides of said support means and integrally and unitarily forming into said support means for attaching said pillow means to said tub, said membrane projecting outwardly from said support means;

said tub further including means cooperating with said first and second flange means for positioning said membrane spaced apart by an air gap from said jet means so as to receive fluid discharged by said jet means.

2. The apparatus of claim 1 wherein said pillow means comprises a polyester- or polyether-based thermoplastic urethane material.

3. The apparatus of claim 1 wherein said membrane is 20 mils thick.

4. The apparatus of claim 1 further including air valve means actuable by a user for adjusting the discharge of fluid by said jet means.

5. Apparatus comprising:

a tub having a side surface therein and a jet means located in said side surface for discharging fluid under pressure therefrom;

a unitarily-molded solid plastic pillow having a flexible membrane formed as a part thereof, said membrane being sized and contoured for supporting the neck and head;

said membrane having an upper edge, a lower edge, and first and second sides, said unitarily-molded solid pillow further including:

first and second side support means on either side of said membrane and integrally formed with said membrane, each side support means providing side support to said membrane;

first and second flange means integrally and unitarily formed with said side support means for attaching said pillow to said tub;

upper collar means for supporting the upper edge of said membrane, said upper collar means further including an upper rim means;

a lower rim means for supporting the lower edge of said membrane;

said lower rim means being gapped away from the tub surface along a selected length thereof to define an opening;

said first and second side support means, upper collar means, and lower rim means forming a support structure for said membrane, said membrane projecting in bubble-like fashion outwardly from said support structure;

said tub further including means cooperating with said flange means for positioning said membrane spaced apart from said jet means by an air gap and in position to receive fluid discharged across said air gap by said jet means; and said upper rim means and first and second flange means further forming a seal with said tub, thereby directing water discharged from said jet means downwardly and through said opening.

6. The apparatus of claim 5 wherein said pillow further includes a splash guard and said tub includes means cooperating with said splash guard and said upper rim means for retaining said pillow in position with respect to said tub.

7. The apparatus of claim 5 wherein said pillow comprises a polyester- or polyether-based thermoplastic urethane material.

8. The apparatus of claim 5 wherein said membrane is 20 mils thick.

9. The apparatus of claim 5 further including air valve means actuable by a user for adjusting the discharge of fluid by said jet means.

* * * * *